US006390392B1

(12) United States Patent
Reiter

(10) Patent No.: US 6,390,392 B1
(45) Date of Patent: May 21, 2002

(54) INJECTION VALVE STEM

(75) Inventor: Ferdinand Reiter, Markgröningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/077,356

(22) PCT Filed: Aug. 16, 1997

(86) PCT No.: PCT/DE97/01761

§ 371 Date: May 26, 1998

§ 102(e) Date: May 26, 1998

(87) PCT Pub. No.: WO98/15733

PCT Pub. Date: Apr. 16, 1998

(30) Foreign Application Priority Data

Oct. 10, 1996 (DE) ..... 196 41 785

(51) Int. Cl.[7] ..... B05B 1/30; F02M 51/00

(52) U.S. Cl. ..... 239/585.1; 239/585.2; 239/585.4; 239/585.5; 239/533.3; 239/533.12; 251/129.15; 251/129.21

(58) Field of Search ..... 239/585.1, 585.2, 239/585.4, 585.5, 533.3, 533.12; 251/129.15, 129.21; 403/300, 305, 362, 273

(56) References Cited

U.S. PATENT DOCUMENTS 4,497,298 A * 2/1985 Ament ..... 123/450
4,610,080 A * 9/1986 Hensley ..... 239/585
5,678,767 A * 10/1997 Rahbar ..... 239/533.2
5,685,485 A * 11/1997 Mock et al. ..... 239/533.12 X
5,860,601 A * 1/1999 Egizi ..... 239/533.12

FOREIGN PATENT DOCUMENTS

| | | | | |
|---|---|---|---|---|
| GB | 1005355 | * | 9/1965 | ..... 239/533.3 |
| GB | 2204357 | * | 5/1997 | ..... 239/533.3 |
| JP | 0050010 | * | 2/1990 | ..... 239/533.12 |
| SU | 596746 | * | 2/1978 | ..... 403/273 |

* cited by examiner

*Primary Examiner*—Robin O. Evans
(74) *Attorney, Agent, or Firm*—Kenyon & Kenyon

(57) ABSTRACT

A valve needle for use in an electromagnetically operable injection valve of a fuel injection system in an internal combustion engine includes a connecting part that is made of a plastic bar and that is connected to an armature and a valve closing element. In order to achieve a tight connection of the valve needle components, the connecting part enters into a form-fitting connection with the armature and with the valve closing element. The form-fitting connection between the connecting part and the valve closing element includes corresponding areas of larger and smaller diameters engaging with one another.

2 Claims, 2 Drawing Sheets

INJECTION VALVE STEM

BACKGROUND INFORMATION

The present invention relates to a valve needle for an injection valve. German Published Unexamined Application No. DE-OS 40 08 675 describes a valve needle for an electromagnetically operable valve comprising an armature, a valve closing element and a sleeve-like connecting tube joining the armature to the valve closing element, which may be spherical, for example. The individual sections are individual parts manufactured separately and joined together by a joining method such as laser welding. The armature completely encompasses the connecting tube radially and at least partially axially, because the connecting tube is secured in a longitudinal through-bore in the armature. The connecting tube itself also has a longitudinal inside through-hole in which fuel can flow in the direction of the valve closing element and then come out close to the valve closing element through radial cross-holes provided in the wall of the connecting tube. Fuel thus flows first inside the valve needle, leaving the valve needle positioned only toward the valve seat.

In addition, U.S. Pat. No. 4,610,080 describes a valve needle in a fuel injection valve which is designed in two parts. A pot-shaped armature is fixedly connected to an elongated metal rod-shaped connecting part on whose downstream end is shaped directly a valve closing body in the form of a spherical section. A connecting sleeve having an internal opening extends out of the bottom part of the pot-shaped armature. The inside opening is provided with several grooves following one another at a distance axially, resulting in successive areas of larger and smaller diameters in the opening. The connecting part projects with its end opposite the valve closing body, which is also grooved and is opposite the valve closing section, into the opening in the connecting sleeve, so the two metal parts are joined together in a form-fitting manner.

German Published Unexamined Application No. DE-OS 195 03 224 describes a three-part valve needle for electromagnetically operable injection valves formed by a tubular armature, a sleeve connector part and a spherical valve closing body. The connecting part made of plastic engages with catch elements on the outer periphery of the armature to provide a secure connection of the armature and the connecting part. The downstream end of the connecting part has a cup-shaped recess in which the spherical valve closing body is snapped or clipped. The bottom part of the recess is so elastic that it widens when the valve closing body is pressed into it, then encircles the valve closing body tightly.

SUMMARY OF THE INVENTION

The valve needle according to the present invention can be manufactured especially easily and inexpensively. Each individual part of the valve needle, namely an armature, a valve closing element and a connecting part that connects the armature to the valve closing element, can be manufactured and machined especially inexpensively because of their very simple contours. The connecting part made of a plastic ensures a lower weight of the valve needle in comparison with metal valve needles. Especially with injection valves having a delivery point that is shifted especially far forward, where relatively elongated valve needles are used, very good dynamic valve properties can be achieved through such a design of the connecting part. The damping properties of the plastic also ensure reduced noise generation. In an advantageous manner, the valve closing element and the connecting part designed according to the present invention have a small outside diameter, so that an injection valve with such a valve needle can be designed to be very slender. The form-fitting connection of the valve closing element and the connecting part designed according to the present invention can be achieved in an especially simple manner and is nevertheless very secure. The possibility of detachment during the axial movement of the valve needle inside the injection valve is completely ruled out with this connection method.

It is especially advantageous that inexpensive bar stock is used for the connecting part, which can be adjusted very easily to an exact length for use on the valve needle in accordance with a desired valve length. In this way, valve needles for injection valves having a delivery point shifted far forward can be designed very easily. The connecting part, which is made of solid plastic, has the advantages of a small outside diameter because no internal flow orifices are provided, and therefore it also has a low mass. The valve needle, which is designed to be very slender, permits an especially narrow design of the injection valve, in particular a reduction in the size of the valve seat body in comparison with known injection valves.

DETAILED DESCRIPTION

Figure 1:
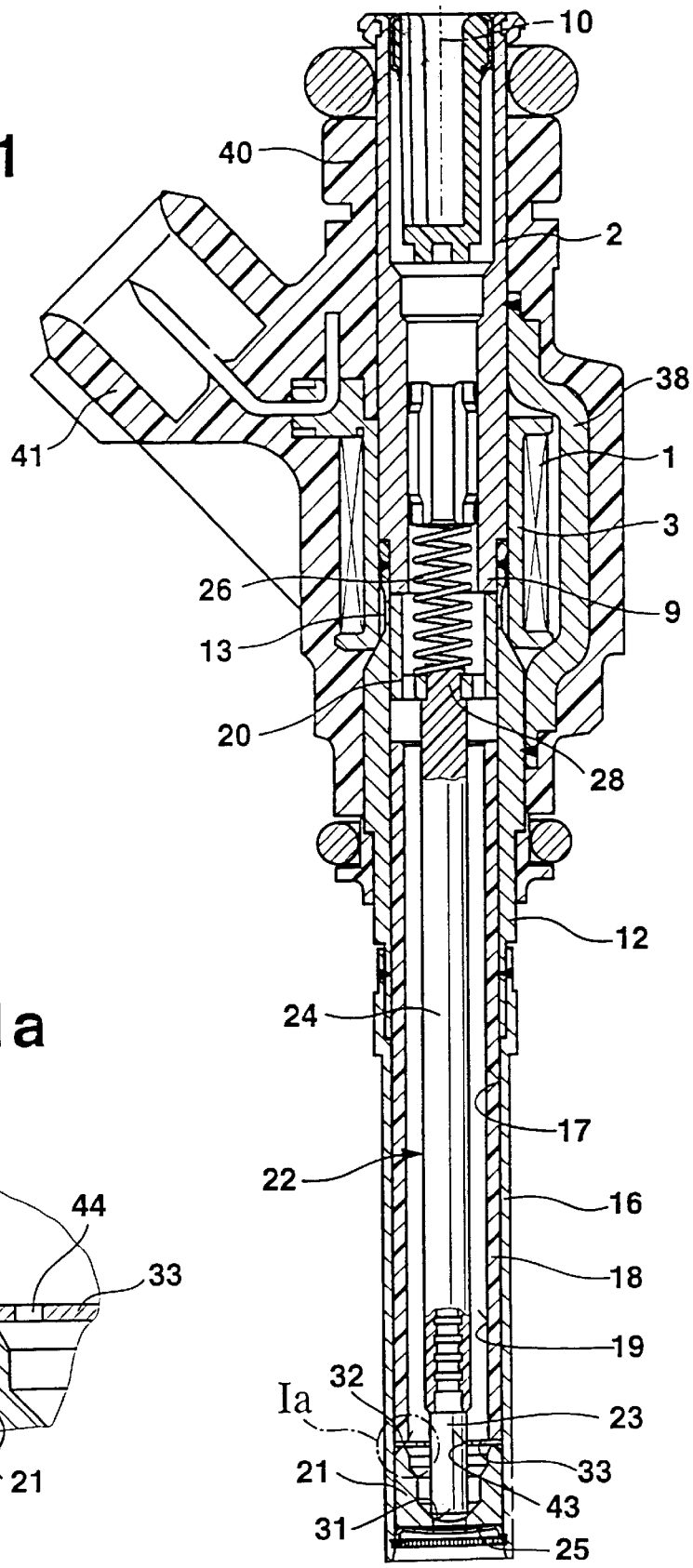
FIG. 1 shows an injection valve with a valve needle according to the present invention.

The valve shown in FIG. 1 is in the form of an electromagnetically operable injection valve for fuel injection systems used in mixture-compression, externally ignited internal combustion engines. This valve has a tubular core 2 as an internal pole which serves as the fuel inlet connection and is surrounded by magnet coil 1. A coil body 3 accommodates a winding of magnet coil 1 and together with core 2 it permits an especially compact design of the injection valve in the area of magnet coil 1.

A tubular metal connecting part 12 is connected tightly, e.g., by welding, to a lower end 9 of core 2 concentrically with a longitudinal axis 10 of the valve and partially surrounds core end 9 axially. An elongated, thin-walled, sleeve-shaped valve seat carrier 16 running from the lower end of connecting part 12 is connected tightly and fixedly to connecting part 12 and has a definitely forward delivery point due to its relatively large axial length. Close to core end 9, connecting part 12 has a magnetic choke point 13 characterized by a much smaller wall thickness than that of the other sections of connecting part 12. Nonmagnetic intermediate parts used in the conventional manner can thus be omitted.

A longitudinal orifice 17 which is concentric with the longitudinal axis 10 of the valve is provided in valve seat carrier 16, which is a thin-walled sleeve and also serves as a connecting part, and an optional sleeve-shaped insulation element 18 which is also elongated is in close contact with the wall of the longitudinal orifice 17. Insulation element 18 made of plastic extends over most of the axial length of connecting part 12 and valve seat carrier 16 between a pot-shaped armature 20 and a valve seat body 21. Insulation element 18, which serves mainly for thermal insulation, is fixedly inserted into valve seat carrier 16 by means of a press fit. An inside longitudinal orifice 19 running concentrically with longitudinal axis 10 of the valve is in turn provided in sleeve-shaped insulation element 18. A solid valve needle 22 designed according to the present invention and provided in longitudinal orifice 19 has a cylindrical valve closing element 23, for example, on its downstream end. The entire valve needle 22 is formed by armature 20, valve closing element 23 and an elongated bar-shaped connecting part 24 which joins armature 20 and valve closing element 23.

Valve seat carrier 16, which is made of nonmagnetic steel, for example, but may also be made of a magnetic ferritic material, surrounds not only the lower end of connecting part 12 but also valve seat body 21 on its opposite end and a spray hole disk 25 attached to it. With the elongated design of valve seat carrier 16, the delivery point of the injection valve is shifted forward to a great extent. With the conventional design positions of injection valves in internal combustion engines, this means that the injection valve with its downstream end and thus with its metering and delivery area definitely extends into the intake tube. This makes it possible to largely avoid wetting of the wall of the intake tube through delivery of spray onto one or more inlet valves, and consequently the exhaust gas emission by the combustion engine can be reduced.

The injection valve is operated in a known way, namely electromagnetically in the case of the injection valve shown in FIG. 1. The electromagnetic circuit with magnet coil 1; core 2 and armature 20 serves to provide axial movement of valve needle 22 and thus opening against the spring force of a restoring spring 26 or closing of the injection valve. Armature 20, which is pot-shaped for example, is aligned with core 2 and is fixedly connected to end 28 of connecting part 24 which faces away from valve closing element 23. Valve seat body 21, which may be cylindrical, for example, and has a fixed valve seat 31, is mounted tightly by welding in longitudinal orifice 17 of the downstream end of valve seat carrier 16 which faces away from core 2.

A guide disk 33, which is attached, for example, to an upper end face 32 of valve a seat body 21 and which faces away from spray hole disk 25, serves to guide valve closing element 23 during the axial movement of valve needle 22 along longitudinal axis 10 of the valve. Armature 20 is guided especially in the area of magnetic choke point 13 during its axial movement in correcting part 12. A specially designed guide face may be provided for this purpose on the outer circumference of armature 20. Valve closing element 23, which is largely cylindrical and has the contour of a spherical section facing valve seat 31, works together with valve seat 31 of valve seat body 21, which tapers in the form of a truncated cone in the direction of flow. On its end face which faces away from guide disk 33, valve seat body 21 is fixedly connected to spray hole disk 25, which may be pot-shaped, for example. Spray hole disk 25 has at least one spray delivery orifice, e.g., four such orifices, which may be formed by punching, etching or eroding. A holding edge of spray hole disk 25 is bent conically outward, so that it is in contact with the inside wall, which is defined by longitudinal orifice 17, of valve seat carrier 16, which results in a radial pressure. Spray hole disk 25 is tightly joined, e.g., by welding, to the wall of valve seat carrier 16.

The depth of insertion of valve seat body 21 determines the length of the stroke of valve needle 22. The one end position of valve needle 22 when magnet coil 1 is not energized is determined by the contact of valve closing element 23 with valve seat 31, while the other end position of valve needle 22 when magnet coil 1 is energized is obtained by the contact of armature 20 with core end 9. Magnet coil 1 is surrounded by at least one control element 38, which is designed as a strap, for example, and serves as the ferromagnetic element, surrounding magnet coil 1 at least partially in the circumferential direction. Outside of valve seat carrier 16, the injection valve is also largely surrounded by a plastic sheathing 40 with an integrally molded electric plug connector 41.

Figure 1A:
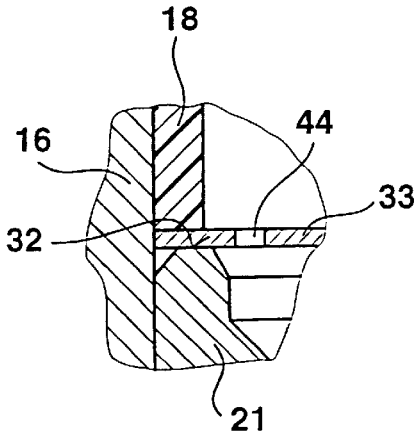
FIG. 1*a* shows an enlarged detail of the area within the hatched circle in FIG. 1.

FIG. 1*a* shows an enlarged detail of the injection valve shown in FIG. 1 in the area of guide disk 33. Guide disk 33 serves to provide radial guidance of valve needle 22 during its axial movement in longitudinal orifice 17 or 19 to prevent excessive wear on valve seat 31 and asymmetrical flow conditions between valve seat 31 and the spray delivery orifices in spray hole disk 25. A central through-hole 43 provided in circular guide disk 33 has a slightly larger diameter than the outside diameter of valve closing element 23 of valve needle 22. These differences in dimensions result in a minimal clearance of approximately 10 $\mu$m. Outside of through-hole 43, multiple passages 44 are provided in guide disk 33, guaranteeing unhindered flow to valve seat 31. Passages 44 may also be so small (e.g., <60 $\mu$m) that they also perform a filter function.

Figure 2:
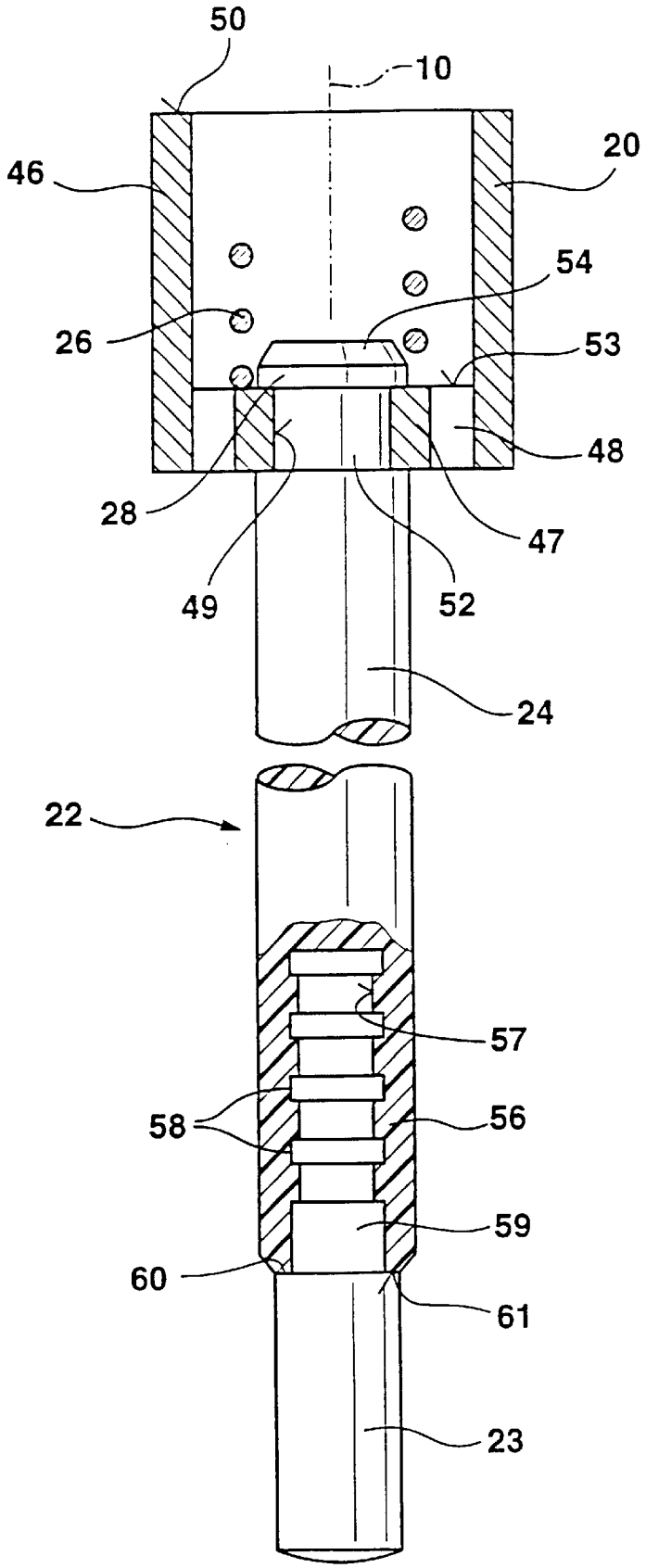
FIG. 2 shows the valve needle of FIG. 1 from the perspective of a different scale.

FIG. 2 shows, on a different scale, valve needle 22, which is composed of armature 20, connecting part 24 and valve closing element 23, as a single part. Pot-shaped armature 20 has a peripheral jacket part 46 running axially and a flat bottom part 47 perpendicular to longitudinal axis 2 of the valve. In bottom part 47 of armature 20 there is at least one passage, e.g., three or four passages 48 through which fuel flows in the direction of valve seat 31. The fluid, in particular a fuel, flows downstream from passages 48 along the outer periphery of connecting part 24 in longitudinal orifice 19. In addition, in bottom part 47 there is provided a central orifice 49 through which connecting part 24 extends with its end 28. Armature 20, which is made of a magnetically soft material, has a wear-resistant surface treatment, e.g., chrome plating, on the outside periphery of jacket part 46 or its upper end face 50, which faces away from valve closing element 23 and serves as a stop.

Connecting part 24 has a peripheral ring groove 52, for example, on its upper end 28 which is connected to armature 20. The base of ring groove 52 has a smaller outside diameter than the areas of bar-shaped connecting part 24 which follow directly upstream and downstream from ring groove 52. Ring groove 52 has an axial length which corresponds approximately to the thickness of bottom part 47 of armature 20, because bottom part 47 engages in ring groove 52 in a form-fitting manner, so that the diameter of the base of ring groove 52 and the diameter of orifice 49 of armature 20 are the same. End 28 of connecting part 24 is designed so that it projects a short distance into the interior of armature 20. End 28 of valve connecting part 24 projects into restoring spring 26 which rests on an inside end face 53 of bottom part 47 outside central orifice 49, thereby ensuring that restoring spring 26 will be centered. End 28 of connecting part 24, partially surrounded by restoring spring 26, has a peripheral chamfer 54, for example, on its end. Connecting part 24 is made of plastic, e.g., by injection molding. Connecting part 24 is inserted into orifice 49 of armature 20 by pressing or crimping or, by a hot-riveting method.

On its lower end 56 facing away from armature 20, connecting part 24 has an inside orifice 57, which has a bottom and is like a blind hole, running concentric with longitudinal valve axis 10 or the longitudinal axis of valve needle 22, and bolt-like valve closing element 23 fits into the orifice 57. A firm and form-fitting connection of connecting part 24 and valve closing element 23 is achieved due to the fact that valve closing element 23 is pressed into orifice 57. Orifice 57 has multiple successive, peripheral grooves 58 spaced a distance apart over its axial extent. Thus, orifice 57 is designed alternately with multiple axially successive areas of larger and smaller diameters. Since valve closing element 23 is designed with a negative structure with respect to orifice 57 on its upper section 59, which engages in connecting part 24, i.e., it also has areas of larger and smaller diameters in alternation, this guarantees a secure, precise form-fitting engagement of valve closing element 23 in orifice 57.

Section 59 of valve closing element 23, which is embedded in connecting part 24 in a form-fitting manner, ends facing away from armature 20 on a lower shoulder 60 starting shoulder 60, downstream valve closing element 23 is designed with a larger diameter than that of section 59 and is in contact with lower end face 61 of connecting part 24. The high-precision-manufactured area of valve closing element 23, which may be made of hardened stainless steel, for example, and is downstream from shoulder 60, is guided in through-hole 43 of guide disk 33, as mentioned previously. In this area downstream from shoulder 60, valve closing element 23 has a smaller outside diameter than connecting part 24 over most of its axial length, for example.

The form-fitting connection of valve closing element 23 and connecting part 24 is achieved, for example, by pressing or crimping valve closing element 23 into orifice 57. However, valve closing element 23 may also be sheathed directly during the plastic injection molding process for manufacturing connecting part 24 as an insertion part. In addition, snap engagement of valve closing element 23 is also conceivable, in which the areas of a smaller diameter of orifice 57 are chamfered, for example. This results in multiple sawtooth-like sections in succession in orifice 57. Another possibility of introducing valve closing element 23 consists of heating and sinking valve closing element 23 into orifice 57. Furthermore, valve closing element 23 may be treated with ultrasound so that heating occurs and the plastic of connecting part 24 close to orifice 57 is partially fused when valve closing element 23 is inserted. After cooling, this yields a form-fitting joint.

What is claimed is:

1. A valve needle for use in an electromagnetically operable injection valve of a fuel injection system in an internal combustion engine, comprising:

an armature;

a metal valve closing element; and a plastic connecting part having a first end coupled to the armature and a second end coupled to the metal valve closing element, wherein the plastic connecting part includes an orifice that has a bottom and runs in a direction of the armature from a lower end face located at the second end of the plastic connecting part, wherein the orifice has at least two successive areas of different diameters, and wherein a section of the metal valve closing element engages the orifice of the plastic connecting part in a form-fitting manner, wherein the armature is a pot with a jacket part and a bottom part having at least one through-hole for a fluid and an orifice for receiving the first end of the plastic connecting part.

2. The valve needle according to claim 1, further comprising a peripheral ring groove provided on a circumference of the first end of the plastic connecting part, wherein the peripheral ring groove engages in a form-fitting manner with an inner wall of the orifice of the bottom part of the armature.

* * * * *